United States Patent [19]

Leitermann

[11] 4,404,937

[45] Sep. 20, 1983

[54] VALVE CONTROLLED STROKE PISTON COMBUSTION ENGINE WITH A CAM SHAFT

[75] Inventor: Wulf Leitermann, Bad Wimpfen, Fed. Rep. of Germany

[73] Assignee: Audi Nsu Union Aktiengesellschaft, Fed. Rep. of Germany

[21] Appl. No.: 328,676

[22] Filed: Dec. 8, 1981

[30] Foreign Application Priority Data

Dec. 10, 1980 [DE] Fed. Rep. of Germany ..... 3046402

[51] Int. Cl.[3] ..... F02D 13/06

[52] U.S. Cl. ..... 123/198 F; 123/90.16; 123/90.17

[58] Field of Search ..... 123/198 F, 90.15, 90.16, 123/90.17, 90.18

[56] References Cited

U.S. PATENT DOCUMENTS

| | | | |
|---|---|---|---|
| 1,331,787 | 2/1920 | Schlatter | 123/198 F |
| 1,350,989 | 8/1920 | Cox | 123/198 F |
| 2,888,837 | 6/1959 | Hellmann | 123/90.17 |
| 4,249,489 | 2/1981 | Bruder et al. | 123/198 F |
| 4,252,093 | 2/1981 | Hazelrigg | 123/198 F |
| 4,284,042 | 8/1981 | Springer | 123/198 F |
| 4,336,775 | 6/1982 | Meyer | 123/198 F |

*Primary Examiner*—Ira S. Lazarus

*Attorney, Agent, or Firm*—Kane, Dalsimer, Kane, Sullivan and Kurucz

[57] ABSTRACT

A valve controlled stroke piston combustion engine is provided with a cam shaft which supports a number of cams equal in number to the inlet and outlet valves. The individual cylinders are switched off by closing the associated inlet and outlet valves. The cams are associated with the valves and are rotatably mounted and axially non-displaceable on the cam shaft. Dogs are fixedly mounted on said cam shaft and cooperate with said cams. Each cam is provided with a front face having a concentric annular section groove with a continuously increasing depth with respect to the rotating axis of the cam shaft. The annular section groove ends have a radial abutment face; and each dog is provided with an axial protrusion on a front face facing the corresponding cam with the protrusion engaging on the abutment face during a switched on valve.

Pretensionable springs are provided for the engagement and disengagement of dogs.

11 Claims, 8 Drawing Figures

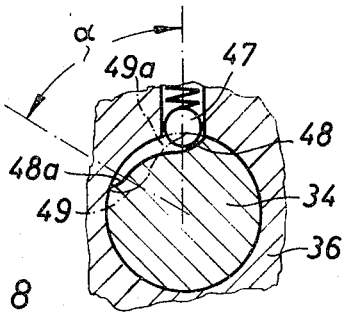
Fig. 8
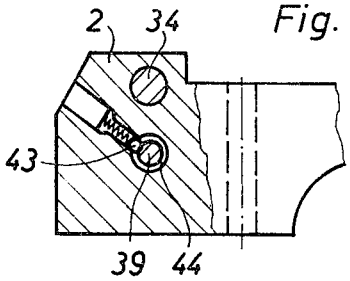
Fig. 7
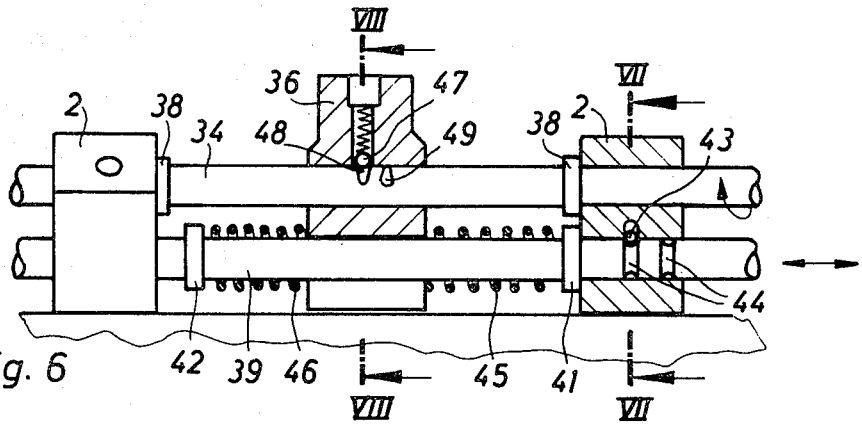
Fig. 6
Fig. 5
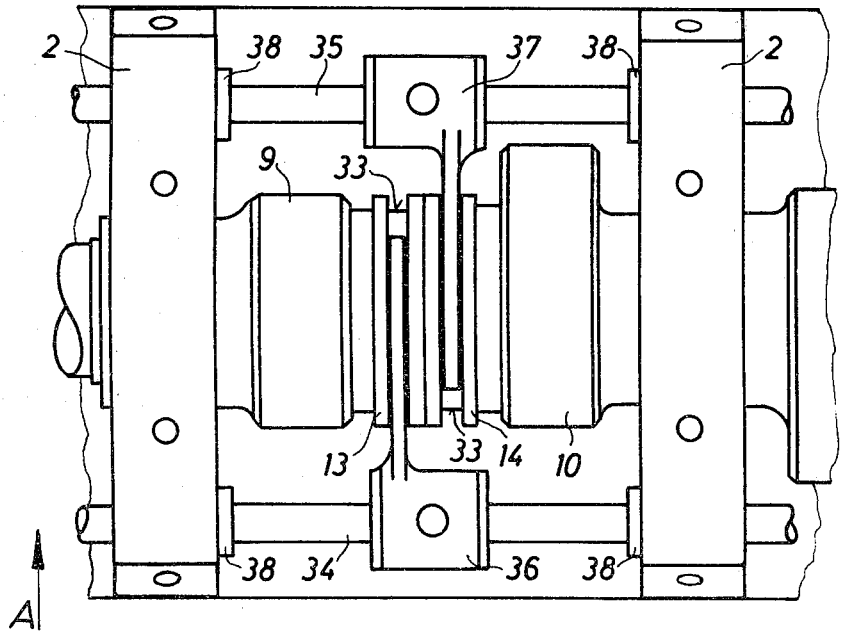

VALVE CONTROLLED STROKE PISTON COMBUSTION ENGINE WITH A CAM SHAFT

BACKGROUND OF THE INVENTION

It has been proposed to shut-off the valves of some cylinders under certain operating conditions, as for example, at low load of the combustion engine or during low load requirements, thus rendering the corresponding cylinders ineffective in combustion engines having a plurality of cylinders. As a result of this temporary switching off and arresting, the cylinders do not operate during a load change whereby economical operation of the combustion engine may be possible.

A combustion engine of the foregoing type is disclosed in DE-OS No. 28 14 164, wherein the valves can be switched on or off as required. For this purpose, the plungers which are disposed between the cam shaft and the valves, are provided with parts which are rotatable towards each other and a gear and corresponding intermediate recesses which are disposed axially opposite of each other and which are either engaging with their gear teeth or with their corresponding recesses, whereby the valves can be either actuated or released. However, such a structure cannot be mounted in a plunger of normal common size, and, therefore, requires an increase of height of the plunger and consequently of the total combustion engine.

SUMMARY OF THE INVENTION

It is therefore an object of the invention to provide a valve controlled stroke piston combustion engine in which the construction height of the combustion engine is not increased by the switch off device.

In accordance with this invention, the position of the cam shaft with respect to the valves remains unchanged, so that the height of the valve drive and therefore of the combustion engine does not have to be enlarged. The pretensioned springs permit a substantial delay but free and reliable engaging and disengaging of the dogs with respect to the associated cam. A further advantage of this design permits the combustion engines to be equipped with the individual parts of the suggested valve switch off device, without requiring any major alterations.

In order to avoid damage and to assure a complete engagement of the protrusion of the dog on the adjustment face of the cam, it is contemplated that each cam which has to be arrested has a block with a front face which is radially displaceable against a spring force. In this fashion, this front face is disposed parallel to the cam front face having the associated annular sector groove, and that the adjacent front face of the associated dog has an axial protruding eccentric segment serving as a temporary engagement face for the front face of the block. Thus, the eccentric segment and the block are disposed in such a manner that they permit engagement of the axial protrusion in the annular sector groove only when the axial protrusion is disposed at the beginning of the annular sector groove.

A safe and positive connection between the cam and the dog can be accomplished by providing a recess at the end of the annular sector groove which corresponds in dimension with the axial protrusion in the circumferential direction and which is further defined by the abutment face and a radial shoulder.

The rigidity between the dog and the sector which cooperates with the cam be effectively increased by providing that the axial protrusion progressively expands in axial direction up to its radial end face which cooperates with the abutment face.

In order to actuate the switch between on and off operation it is suggested that the dogs be axially displaceable by means of switch forks. These switch forks are axially displaceable on guide rods and are spring loaded in the one or the other direction by means of releasable springs mounted on rods. Releasable arresting means are provided for the switch forks which retain the switch forks in position and during rapid release operation, displaces them into the other position under spring tension.

For purposes of arresting the given position of the dog, the arresting device may be provided with a switch rod which is provided with two oppositely offset recesses into which a yielding arresting member engages on the switch fork.

A space saving arrangement may be advantageously obtained by having the guide rod and the switch rod disposed parallel to the cam shaft while being mounted in bearing blocks of the cam shaft.

For similar purposes, it is suggested in a further embodiment of the invention that each guide rod and each switch rod be disposed on both sides of the cam shaft, and that a valve be switchable from the one side for each cylinder to be switched off and that the other valve is switchable to switch off the cylinder on the other side.

The cams which are associated with the valves to be switched off may be switched off or switched on in response to the operating parameters of the combustion engine, as for example, the number of rotations or the load and the number of rotations of the combustion engine could be the operating parameters.

A simplified structure of the invention is realized by connecting the switchable cams of the inlet and outlet valves of a cylinder and that a single common dog cooperates therewith.

In order to prevent switching off of the cams at a position when the opening of both valves overlap whereby both valves may stay open to an insignificant extent, the device for displacing the cams may be controllable by an electronic sensor which senses the position of the cam shaft with respect to the cams. With this sensor, switching off of the valves can be prevented at the point of overlap.

BRIEF DESCRIPTION OF THE DRAWINGS

One embodiment of the invention will be described in detail in conjunction with the accompanying drawings, in which:

FIG. 5 is a plan view of part of a cam shaft with adjacent structural units for the engagement and disengagement of the dogs;

FIG. 6 is a side view of the shaft and units shown in FIG. 5 in direction of arrow S;

FIG. 7 is a fragmentary view of a bearing block with a section taken along line VII—VII in FIG. 6; and FIG. 8 is an enlarged fragmentary sectional view through a switch fork with switch rod along line VIII—VIII in FIG. 6.

DETAILED DESCRIPTION

Figure 1:
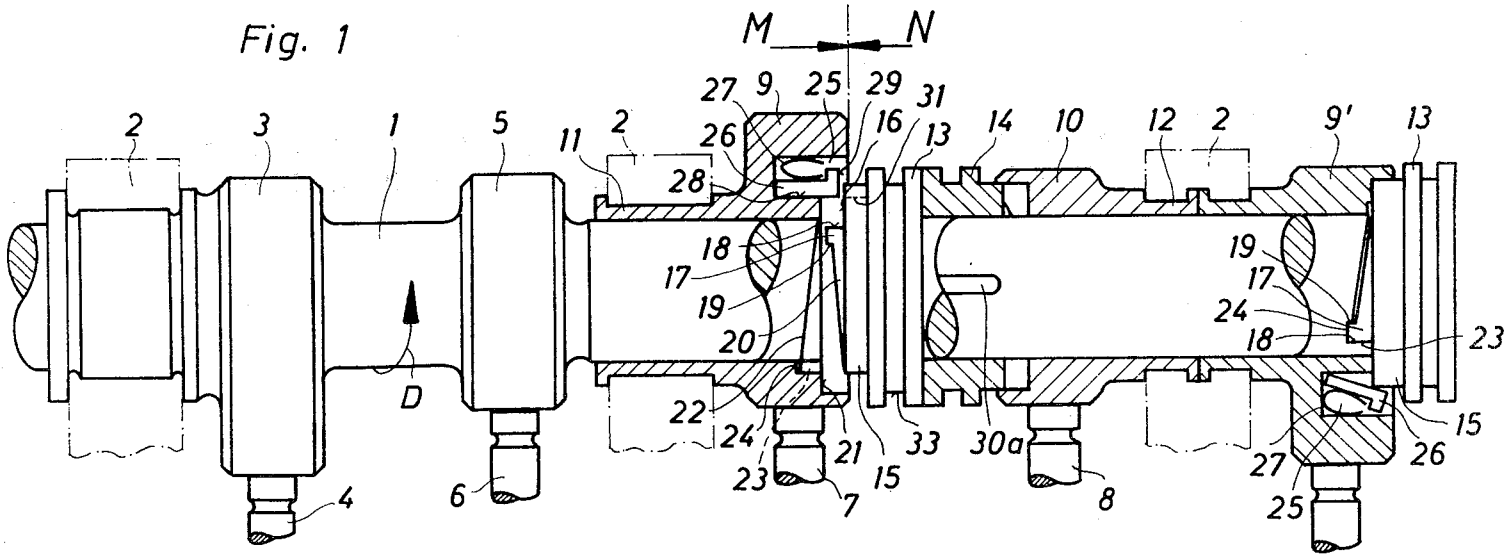
FIG. 1 is a fragmentary side view of part of a cam shaft, partially in a section, in accordance with the invention.

Referring initially to FIG. 1, the part of a cam shaft 1 is shown for a combustion engine provided with a plurality of cylinders which are arrestable by switching off the associated inlet and outlet valves. However, for clarification, the drawings only show the cams for the actuation of non-switchable inlet and outlet valves of a single cylinder and three switchable valves in section. The cam shaft 1 is mounted in a conventional manner in the housing of the combustion engine in bearings 2 shown with dash-dotted lines and is rotated by a drive wheel, not shown, in the direction of arrow D. The left cam 3 of the stationary connected pair of cams on the cam shaft 1 for the non-switchable valves acts in the usual manner with the associated partially shown inlet valve 4 and the right cam 5 cooperates with a partially shown outlet valve 6. An outlet valve 7 and an inlet valve 8 is associated with the arrestable cylinder and are actuated by associated cams 9 and 10. The cams 9 and 10 are rotatably mounted on the cam shaft by means of a sleeve attachment 11 and 12, respectively. A dog 13 cooperates with cam 9 and a dog 14 shown in section cooperates with cam 10 and are axially displaceably mounted on cam shaft 1. In the position shown, the cams 9 and 10 are in a switched off position and the associated cylinder is arrested.

An axial protrusion 17 is provided on a protruding shoulder 15 mounted on the front face 16 of each dog 13 and 14 facing cam 9 and 10 for switching on or off the valves. In this connection, the axial protrusion 17 is provided with a radial end face 18 and a radial counter face 19 which faces away from end face 18. For increasing its stability, the axial protrusion 17 is provided with an annular sector-like reinforcement 20 which extends from the front face 16 to the counter face 19. A concentric annular sector groove 22 is provided on the front face 21 of each cam 9 and 10 positioned opposite of front face 16 of dogs 13 or 14 and axially with respect to the protrusion 17 and its associated reinforcement 20. Thus, this annular sector groove is provided with a continuously increasing depth which ends on a radial abutment face 23 of cam 9. A recess 24 is provided at the end of the annular sector groove 24 which corresponds in dimension with the axial protrusion 17 of dog 13 and into which the axial protrusion 17 engages with its radial end face 18 and its radial counter face 19 during the switching on operation, at which time the end face 18 engages on the abutment face 23 and the radial counter face 19 on a radial shoulder 19*a* (FIG. 2) on cam 9.

As will be evident from cam 9, a square recess 25 is provided in the elevation of each switchable cam extending from the front face 21 in a radial and axial manner. A square block 26 is adapted to be inserted in recess 25 and is supported radially at the bottom of recess 25. The block 26 is urged radially to the inside against the radial inner wall 28 of the recess 25 by a spring 27 which is also mounted in the recess. The block 25 with the associated front face 26 facing dog 13 is thereby positioned immediately towards the portion of front face 16 which encompasses the axial protrusion 17 with its reinforcement 20 disposed on front face 16.

Figure 2:
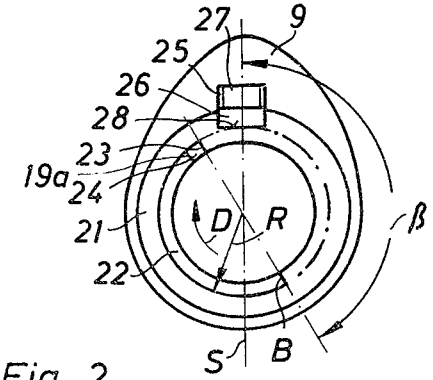
FIG. 2 is a view of a cam of the cam shaft in direction of the arrow N in FIG. 1.

FIG. 2 shows a view of the cam in the axial direction of arrow N. As will be evident in this view, the annual sector groove 22 located on the front face 21, observed in the direction of arrow D, representing the rotation of cam shaft 1, starts in an angle $\beta$ of about 150° after the block 26 is at the top of the cam travel and then extends from position B in a radius progressively deepening about 180° to the abutment face 23. Wall 28, which forms the radial inner engagement for block 26, is positioned tangential on the radius R which is indicated in dash-dot lines on front face 21.

Figure 3:
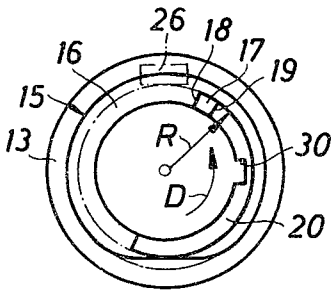
FIG. 3 is a view of a dog of the cam shaft in direction of the arrow M in FIG. 1.
Figure 4:
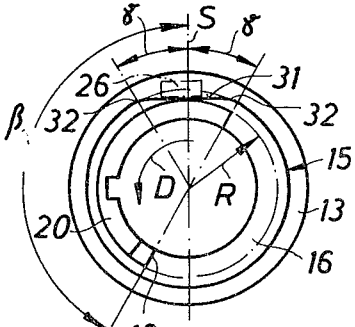
FIG. 4 is a view similar to FIG. 3, but with the dog in a changed position.

The illustration in FIG. 3 shows the dog 13 in the axial direction of arrow M. The axial protrusion 17 which is mounted on the front face 16 of shoulder 15 is limited by the radial end face 18, the radial counter face 19 and the radius R. The reinforcement 20 also extends within a radius R about 180° of front face 16 progressively expanding to the counter face 19, in the direction of arrow D, representing the rotation of cam shaft 1. The dog 13 is keyed to the shaft by means of a groove 30, but is at the same time axially displaceable by means of a wedge 30*a* (FIG. 1) located on cam shaft 1. Furthermore, in this Figure, block 26 is seen positioned opposite the portion of the front face 16 which encompasses the axial protrusion 17 with its associated reinforcement 20 and which is positioned between the radius R, which is indicated in dash-dot lines on front face 16, and the outer circumferential face of shoulder 15. In FIG. 4, the dog 13 was rotated by the cam shaft 1 in arrow direction D, from the position of FIG. 3 into a position wherein the radial end face 18 is positioned about 150° with respect to the center of block 26 or the cam 9 in relationship to the center line S. The dog 13 is provided with a switch face 31 formed as a result of the circumferential face of shoulder 15 being offset back to the radius R, so that an excentric segment remains on front face 16. In the shown illustration, this switch face 31 extends in a circumferential direction over an area which encompasses an angle $\gamma$ of about 30°, for example, at both sides of center line S. A gradual transmission is formed by each abutting face 32 between the circumferential face of shoulder 15 and the switching face 31.

The switching on of cam 9 is performed in accordance with FIGS. 1 to 4, by an axial displacement of dog 13 by means of a switch fork (not shown) which engages into an annular groove 33 of the dog. In this manner, the front face 16 of the dog 13 is moved into engagement with the front face 29 of block 26. Thereby, a distance remains between the protrusion 17 of the dog 13 and the front face 21 of cam 9 which permits free rotation of the dog 13 with respect to cam 9 in the direction of arrow D. When reaching the position shown in FIG. 4, the block 26 is disengaged due to the offset switch face 31. As a result, dog 13 is completely released in axial direction with respect to cam 9 and the protrusion 17 engages front face 21. At this moment, the protrusion 17 is immediately at its starting position, namely, at position B of annular sector groove 22. Since the displacement of the dog 13 is performed under the influence of pretension of a spring, as will be described later, the dog 13 with its associated protrusion 9 moves directly into the annular sector groove 22 of the cam 9 and finally engages with its end face 18 on the abutment face 23 of cam 9, after rotating 180°. Due to the correct angle connection, cam 9 is finally rotated by dog 13. After the following actuation of the associated valve 7, cam 9 is relieved. This momentary relief results in protrusion 17 completely engaging the abutment face 23 due to the force of the pretensioned spring acting on dog 13, so that the protrusion with its radial counter face 19 engages into the radial shoulder 19*a* of recess 24. The positive connection, which prevents a relative movement between the dog 13 and cam 9 in circumferential direction, is shown on the right cam 9' of FIG. 1. In this illustration, it can also be seen that the block 26 moves to the abutment face 23 over the abutting face 32 and onto the circumferential face of shoulder 15, after the dog 13 has been released and is further moved, so that it is pushed radially outward in its recess 25 against the force of spring 27 and remains in this position, when it is in the switched on position.

Referring now to the plan view of FIG. 5, cams 9 and 10 are shown mounted on the cam shaft 1. Two guide rods 34 and 35 are pivotably mounted parallel to cam shaft 1 in bearing blocks 2, but is mounted axially non-displaceable by collars 38. A switch fork 36 which engages into the annular groove 33 of dog 13 is displaceably mounted on guide rod 34, and a switch fork 37 which engages into the annular groove 33 of the dog 14 is displaceably mounted on guide rod 35.

As illustrated in the side view of FIG. 6, each switch rod 39 and 40 are provided in the bearing blocks 2 below guide rods 34 and 35 at both sides of the cam shaft. The switch rod 39 as well as the switch rod 40 are longitudinally displaceable in bearing block 2. A collar 41 mounted on switch rod 39 limits a right end position, as shown in the drawing, and a collar 42 limits a left end position in bearing block 2. These two end positions of the switch rod 39 are determined by an arresting means which is formed by a spring loaded ball 43 and corresponding annular grooves in the switch rod 39 mounted in bearing block 2 (see FIG. 7). Each pressure spring 45 and 46 are inserted between the switch fork 36 and the collars 41 and 42 of switch rod 39. A spring loaded ball 47 is disposed in switch fork 36 which engages into a recess 48 of guide rod 34, when the switch fork 36 has moved the dog 34 into the switch on position with respect to cam 9. The ball 47 engages into a recess 49, when the switch fork 36 has moved the dog 13 into the switch off position.

The partial sectional view shown in FIG. 8 illustrates in an enlarged scale the recesses 48 and 49 in guide rod 34 which cooperate with the spring loaded ball 47 in switch fork 36. The recess 49 is offset, for example, by an angle $\alpha$ of 60° with respect to recess 48. A groove 48*a* is disposed adjacent to recess 48 in the circumferential direction of the guide rod 34, the depths of which is gradually decreasing with respect to the axial plane of recess 49, while in the opposite direction, a groove 49*a* is disposed adjacent to recess 49 whose depth is gradually decreasing with respect to the axial plane of recess 48.

The displacement of the switch forks for the engagement or disengagement of dogs 13 or 14 in accordance with FIGS. 5 to 8 functions in the following manner. Starting from the position shown in FIG. 5, wherein the cams 9 and 10 are shown in their switched off position, as also shown in FIG. 1, the switching on is performed by a displacement of the switching rod 39 from the end position shown in FIG. 6 into the left end position wherein the collar 42 engages the left bearing block 2. Thereby, a substantially stronger pretension is exerted on pressure spring 45 with respect to pressure spring 46. When the guide rod 34 is pivoted around the angle $\alpha$, the ball 47 of the arresting means of switch fork 36 is pushed through groove 49*a* and out of engagement with recess 49, so that the switch fork 36 is released. Thereby, a sudden force to the left is exerted onto the switch fork 36 due to the pretension of pressure spring 45 and transmitted to dog 13. When the dog 13 is engaged with cam 9 in the manner described with respect to FIGS. 1 to 4, the ball 47 engages recess 48, as shown in FIG. 6, whereby the switch on position is arrested.

For switching off or disengagement of the dogs 13, the switch rod 39 is pushed into the end position shown in FIG. 6, wherein the collar 41 engages on the right bearing block 2, and whereby the pressure spring 46 is pretensioned with respect to pressure spring 46, as shown. By pivoting the guide rod 34 from the position shown in FIG. 6 by the angle $\alpha$, the ball 47 is pushed through the groove 48*a* out of disengagement, thus releasing the switch fork 36, whereby the switch fork 36 is suddenly moved to the right by the force of the pressure spring 46. This switch on or switch off position is again arrested by the engagement of balls 47 into the recess 49.

Naturally, dog 14 which cooperates with cam 10 is simultaneously actuated by the switch fork 37 when switch fork 36 is actuated, so that the valves associated with one cylinder are commonly switched off or on. The switch rods 39 and 40, as well as the guide rods 34 and 35 can be automatically actuated electromagnetically or hydraulically in response to certain operating parameters of the combustion engine.

The invention is not limited to the illustrated exemplified embodiment. For example, for transmitting the stroke movement between the cam and the valves, cup plungers may be provided in a known manner. It is also possible that the switchable cams of the valves of a cylinder are connected with each other on the cam shaft and are switched on or off by a single dog. In such an embodiment, an electronic sensor device, for example, is provided, which prevents the valves being switched off at the overlapping point and therefore remain partially opened.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A valve controlled stroke piston combustion engine provided with a cam shaft which supports a number of cams equal in number to the inlet and outlet valves, the individual cylinders being switched off by stopping the associated inlet and outlet valves, the cams being associated with the valves, the cams being rotatably mounted and being axially non-displaceable on the cam shaft, dogs being mounted fixedly on said cam shaft cooperating with said cams, and each of said cams being provided with a front face with a concentric annular section groove with a continuously increasing depth with respect to the rotating axis of the cam shaft, said annular section groove ends having a radial abutment face, each dog being provided with an axial protrusion on a front face facing the corresponding cam, said protrusion engaging on the abutment face during a switched on valve and the pretensionable springs being provided for the engagement and disengagement of dogs.

2. A valve controlled stroke piston combustion engine in accordance with claim 1, wherein each stoppable cam is provided with a block having a front face being radially displaceable against a spring force, whereby said front face is disposed parallel to the cam front face having an associated annular sector groove, the adjacent front face of the associated dog being provided with an axially protruding eccentric segment as a temporary engagement face for the front face of the block, whereby the eccentric segment and the block are so disposed that they permit an engagement of the axial protrusion into the annular sector groove only when the axial protrusion is disposed at the start of the annular sector groove.

3. A valve controlled stroke piston combustion engine in accordance with claim 1, wherein a recess is provided at the end of the annular sector groove which corresponds to the dimension of the axial protrusion in a circumferential direction and is limited by the abutment face and by a radial shoulder.

4. A valve controlled stroke piston combustion engine in accordance with claim 1, wherein the axial protrusion progressively expands in an axial direction up to its radial end face which cooperates with the abutment face.

5. A valve controlled stroke piston combustion engine in accordance with claim 1, wherein the dogs are axially displaceable by means of switch forks, said switch forks being axially displaceable on guide rods and being spring loaded by means of releasable springs which are mounted on rods and a releasable arresting device being provided for the switch forks which retains the switch forks in one position and while releasing, rapidly displaces them into another position under spring tension.

6. A valve controlled stroke piston combustion engine in accordance with claim 5, wherein the device is provided with a cam rod having two oppositely offset recesses into which a yielding arresting member engages on the switch fork.

7. A valve controlled stroke piston combustion engine in accordance with claim 5, wherein the guide rod and the switch rod are disposed parallel to the cam shaft and are mounted in bearing blocks on said cam shaft.

8. A valve controlled stroke piston combustion engine in accordance with claim 7, wherein each guide rod and a switch rod are disposed on both sides of the cam shaft and a valve is switchable from the one side for each cylinder to be switched off and the other valve is switchable to switch off the cylinder on the other side.

9. A valve controlled stroke piston combustion engine in accordance with claim 1, wherein the cams are associated with the valves which ave to be switched off, are adapted to be switched on or off with respect to the combustion engine in accordance with certain operating parameters.

10. A valve controlled stroke piston combustion engine in accordance with claim 1, wherein the switchable cams of the inlet and outlet valves of a cylinder are connected with each other and a single common dog cooperates therewith.

11. A valve controlled stroke piston combustion engine in accordance with claim 10, wherein the device for displacing the cam is controllable by an electronic sensor which senses the position of the cam shaft with respect to the cams.

* * * * *